United States Patent [19]

Tagoku

[11] Patent Number: 4,588,285

[45] Date of Patent: May 13, 1986

[54] RESIDUAL TONER COLLECTING DEVICE FOR ELECTROPHOTOGRAPHIC COPIER

[75] Inventor: Izumi Tagoku, Tokyo, Japan

[73] Assignee: Ricoh Company, Ltd., Tokyo, Japan

[21] Appl. No.: 622,489

[22] Filed: Jun. 20, 1984

[30] Foreign Application Priority Data

Jun. 20, 1983 [JP] Japan ..... 58-109346
Aug. 4, 1983 [JP] Japan ..... 58-141892

[51] Int. Cl.[4] ..... G03G 15/08

[52] U.S. Cl. ..... 355/15; 355/3 DD; 118/652

[58] Field of Search ..... 355/3 DD, 14 D, 15; 430/125; 118/652

[56] References Cited

U.S. PATENT DOCUMENTS 3,580,673 5/1971 Yang ..... 355/15
3,780,391 12/1973 Leenhouts ..... 355/15 X
4,123,154 10/1978 Fisher ..... 355/15
4,361,922 12/1982 Karal ..... 355/15 X

*Primary Examiner*—A. C. Prescott
*Attorney, Agent, or Firm*—Oblon, Fisher, Spivak, McClelland & Maier

[57] ABSTRACT

A residual toner collecting device efficiently collects residual toner remaining untransferred on a photoconductive element of an electrophotographic copier by cleaning the photoconductive element. A scavenger roller and a flat counterelectrode, which constitute the collecting device, are supplied with dc bias voltages which are different in polarity. The polarities of the dc bias voltages are switched each to the opposite polarity only for a predetermined part of the period between a start of movement of the photoconductive element and a stop of the movement. Further, an ac bias voltage is applied to at least one of the scavenger roller and the counterelectrode superposed on the dc bias voltage for the predetermined period. The predetermined period is a period during which cleaning the photoconductive element is not required.

13 Claims, 11 Drawing Figures

RESIDUAL TONER COLLECTING DEVICE FOR ELECTROPHOTOGRAPHIC COPIER

BACKGROUND OF THE INVENTION

The present invention relates to a cleaning device installed in an electrophotographic copier for removing an untransferred part of toner which remains on a photoconductive element. More particularly, the present invention is concerned with a residual toner collecting device capable of effectively self-cleaning electrode members which are apt to be contaminated by a part of toner removed from the surface of the photoconductive element and various impurities brought by the cleaning device, thereby maintaining stable collection performance.

Generally, in an electrophotographic copier of the type developing an electrostatic latent image formed on a photoconductive element by means of toner to produce a visible toner image, untransferred toner, if small in amount, remains on the surface of the photoconductive element even after the transfer of the toner image to a paper sheet. For the removal of the untransferred or residual toner, a copier of type described is usually furnished with a cleaning device which may comprise a magnetic brush or a fur brush, for example. Such a cleaning device, in turn, is furnished with a toner collecting device adapted to collect the removed residual toner so as to allow it for reuse. The toner collector, which has been proposed in various configurations, may comprise a scavenger roller, a blade, a flat counterelectrode, and an air filter. The scavenger roller is applied with a dc voltage opposite in polarity to a charge deposited on toner, so that the residual toner removed from the photoconductive element by, for example, a fur brush may be attracted onto the scavenger roller. The toner deposited on the scavenger roller is scraped off by the blade. The counterelectrode is located to face the scavenger roller and applied with a dc voltage common in polarity to the charge on the toner. Dust and other impurities entrained by a stream of air generated by the rotating fur brush are effectively separated from the toner by the air filter.

In the particular toner collector described above, the impurities entrained by the air stream mentioned include small pieces, or naps, of the fur brush which are produced during rotation of the brush. Since the fur brush is usually made of Teflon which has a tendency to charging to negative (−) polarity, naps of the brush stick to the flat counterelectrode which is usually applied with a positive (+) dc voltage, tending to accumulate thereon with the lapse of time. Meanwhile, the naps of the Teflon brush are as long as about 30–400 microns which is far larger than the diameter of toner particles which is about 6–10 microns and, additionally, the charge level of the toner particles is substantial. This allows the toner removed from the photoconductive element by the fur brush to easily stick to naps separated from the brush.

For the above reasons, the naps of the Teflon brush carrying toner particles therewith stick to the counterelectrode before sucked by the air filter. Accumulating gradually on the counterelectrode, the naps of the brush reduces the clearance between the counterelectrode and the scavenger roller little by little. For example, an initially designed clearance of about 8 millimeters may even be reduced to about 1–3 millimeters. The reduced clearance serves to increase the velocity of the air stream developed by the fur brush so that the toner removed by the fur brush from the photoconductive element is entrained by the rapid air stream to be entirely sucked by the air filter without being caught by the scavenger roller.

In the above situation, the toner removed from the fur brush fails to be collected for reuse, while the toner flown past the scavenger roller stays on the filter to significantly deteriorate its performance and make the service life far shorter than expected.

In an electrophotographic copier which uses, as a developer, toner particles having diameters not larger than about 2 microns, for example, the residual toner tends to remain deposited on the scavenger roller due to its intense adhesion and because the blade cannot easily scrape it off. As a result, capture of the toner by the scavenger roller becomes difficult thereafter, limiting the efficiency of toner collection.

As discussed above, performance of a prior art residual toner collector used in combination with a cleaner of the type using a fur brush or a magnetic brush is quite limited by the fact that a part of toner and various impurities floating in the air tend to stick to the surface of the scavenger roller and/or the counterelectrode. No implementations have been proposed to settle this problematic situation. Stated another way, no propositions have been made concerning a method or an apparatus for effectively removing a part of toner and impurities which deposite on the scavenger roller or the counterelectrode.

SUMMARY OF THE INVENTION

The present invention has been elaborated to overcome the drawbacks inherent in the prior art residual toner collecting device of the type comprising a scavenger roller and a flat counterelectrode.

It is an object of the present invention to provide a residual toner collecting device capable of separating untransferred toner which is removed by a cleaning device from the surface of a photoconductive element and impurities which come out of the cleaning device together with the untransferred toner, thereby efficiently collecting the toner only.

It is another object of the present invention to provide a residual toner collecting device capable of preventing untransferred toner removed from the surface of a photoconductive element by a cleaning device and impurities entrained out of the cleaning device together with the untransferred toner from attracting each other and, thereby, adhering to a counterelectrode plate to accumulate thereon with the lapse of time.

It is another object of the present invention to provide a residual toner collecting device capable of preventing very fine toner particles removed from the surface of a photoconductive element by a cleaning device from being attracted by a scavenger roller to stick fast thereto and accumulate thereon little by little.

It is another object of the present invention to provide a generally improved residual toner collecting device for an electrophotographic copier.

In one aspect of the present invention, there is provided a device for collecting an untransferred dry process developer for use with a cleaning device which removes an untransferred dry process developer remaining on an image bearing member of an image forming apparatus. The device comprises a dc bias power source, a first electrode member applied by the dc bias power source with a dc bias voltage opposite in polarity to a charge deposited on the untransferred residual developer which is removed by the cleaning unit, a second electrode member applied by the dc bias power source with a dc bias voltage common in polarity to the charge deposited on the untransferred residual developer, and bias voltage controller for varying a magnitude of each of the dc bias voltage which are applied by the dc bias power source to the first and second electrode members.

In another aspect of the present invention, there is provided a device for collecting untransferred residual toner for use with a cleaning unit which removes untransferred toner remaining on a photoconductive element of an electrophotographic copier, comprising a dc bias power source, a first electrode member applied by the dc bias power source with a dc bias voltage opposite in polarity to a charge deposited on the untransferred residual developer which is removed by the cleaning unit, a second electrode member applied by the dc bias power source with a dc bias voltage common in polarity to the charge deposited on the untransferred residual developer, and a bias voltage polarity changeover device for changing polarities of the dc bias voltage applied to the first and second electrode members each to an opposite polarity for a predetermined period at a predetermined interval.

In another aspect of the present invention, there is provided a device for collecting untransferred residual toner for use with a cleaning unit which removes an untransferred toner remaining on a photoconductive element of an electrophotographic copier, comprising a dc bias power source, a first electrode member applied by the dc bias power source with a dc bias voltage opposite in polarity to a charge deposited on the untransferred residual developer which is removed by the cleaning unit, a second electrode member applied by the dc bias power source with a dc bias voltage common in polarity to the charge deposited on the untransferred residual developer, and an ac bias voltage superposing device for superposing an ac bias voltage for a predetermined period at a predetermined interval to at least one of the dc bias voltage applied to the first and second electrode members.

The above and other objects, features and advantages of the present invention will become apparent from the following detailed description taken with the accompanying drawings.

DESCRIPTION OF THE PREFERRED EMBODIMENTS

While the residual toner collecting device for an electrophotographic copier of the present invention is susceptible of numerous physical embodiments, depending upon the environment and requirements of use, substantial numbers of the herein shown and described embodiments have been made, tested and used, and all have performed in an eminently satisfactory manner.

Figure 1:
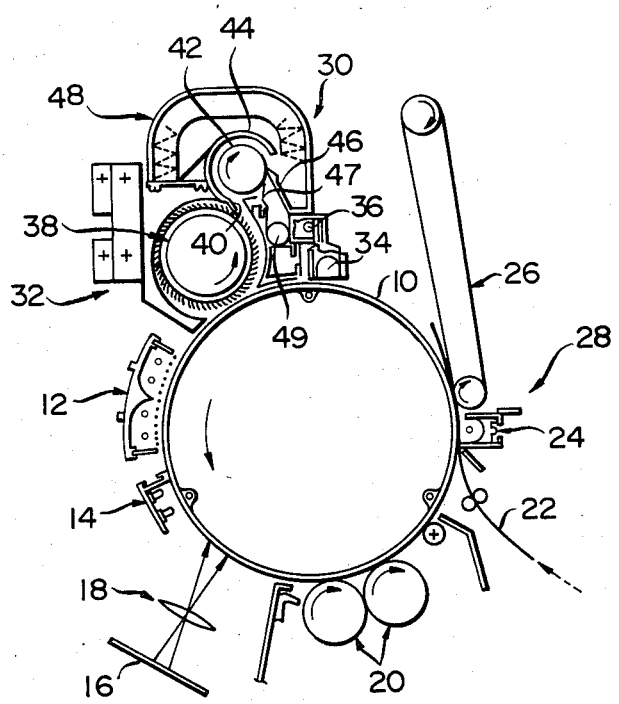
FIG. 1 is a schematic view of an electrophotographic copier in which a cleaning unit with a residual toner collecting device in accordance with the present invention is installed.

Referring to FIG. 1 of the drawings, there are schematically shown a cleaning unit with a residual toner collecting device in accordance with the present invention, and an electrophotographic copier in which the cleaning unit is installed. A photoconductive element 10 in the form of a drum, which serves as a recording medium, has an organic photoconductor (OPC) surface layer whose electric resistance is high. A drive unit (not shown) causes the drum 10 into rotation as indicated by an arrow in the drawing. Arranged around the drum 10 are a charger 12 for uniformly charging the surface of the drum 10, an erase lamp 14 for illuminating areas of the drum surface other than necessary one to dissipate the charge deposited thereon by the charger 12 and, thereby, prevent toner from depositing in the needless areas, an imaging system 18 for focusing an image on an original document 16 to the drum surface, and a developing sleeve 20 for developing an electrostatic latent image formed on the drum surface by the imaging system 18 to produce a visible toner image, these elements being positioned in this order with respect to the direction of rotation of the drum 10.

Further, disposed downstream the developing sleeve 20 is transfer device 28 made up of a transfer charger 24 for transferring the toner image from the drum 10 to a paper 22 which is supplied from a sheet feed device (not shown), and a separator belt 26 adapted to separate the paper 22 carrying the toner image thereon from the surface of the drum 10. The paper 22 separated from the drum surface is transported to a fixing unit (not shown) to be fixed thereby.

A cleaning unit 32 equipped with a residual toner collecting device 30 of the present invention is located downstream of the transfer device 28. As shown, the cleaning unit 32 comprises a corona charger 34 for uniformalizing the unstable polarity of toner remaining on the drum surface after the image transfer, a discharging lamp 36 for emitting light to refresh the drum 10 and serve as secondary cleaning means, and a fur brush 38 rotatable as indicated by an arrow in order to remove untransferred toner remaining on the drum surface. The toner removed by the fur brush 38 is knocked down by a flicker 40 and, then, entrained by a stream of air generated by the rotation of the fur brush 38 to be fed to the toner collector 30 of the present invention.

The toner collector 30 mainly comprises a rotatable scavenger roller 42 for attracting the toner knocked down by the flicker 40 and entrained by the air stream to cause it deposite thereoon, and a flat or plate-like counterelectrode 44 facing the scavenger roller 42. The scavenger roller 42 constitutes a first electrode member and the counterelectrode 44, a second electrode member. A dc power source 50 (see FIG. 5) applies to the scavenger roller 42 a bias voltage opposite in polarity to the charging polarity of the corona charger 34, i.e. charge deposited on the toner. The power source 50 also applies to the counterelectrode 44 a bias voltage which is common in polarity to the charge deposited on the toner. The toner collector 30 further includes a separator 46 for scraping off various impurities larger in diameter than the toner which sticks to the surface of the scavenger roller 42, and an air filter 48 for removing by suction a par of the toner and impurities which are enrained by the air stream developed by the fur brush 38 and floating in the air without being deposited on the surface of the scavenger roller 42.

With reference to FIG. 1, the operation of the copier having the cleaning unit 32 with the residual toner collector 30 of the present invention will be described.

First, the charger 12 uniformly charges the surface of the drum 10 by means of a high voltage of a predetermined polarity, e.g. negative (−) 7 kilovolts corona discharge. Then, the erase lamp 14 illuminates those regions of the drum surface which have no relation with images. Thereafter, the imaging system 18 forms a latent image corresponding to an image on the original document 16 electrostatically on the drum surface. The latent image is developed to become a toner image by the developing sleeve 20 which is applied with a bias volage in the range of, for example, (−)80 to (−)400 volts. The toner image is effectively transferred to the paper 22 by the transfer charger 24. The paper 22 carrying the toner image is separated from the drum surface by the separator belt 26 and, then, fixed by the fixing unit (not shown).

Meanwhile, the drum 10 carrying untransfered residual toner thereon is further rotated until the residual toner reaches the cleaning unit 32. In the cleaning unit 32, the corona charger 34 charges the residual toner on the drum surface by means of, for example, 5.5 kilovolts corona discharge so that the toner polarity is uniformalized to positive (+). Then, the discharging lamp 36 illuminates the toner, but the charge on the toner is maintained. The toner on the drum surface reached the fur brush 38 is removed by the rotating fur brush 38. Acting between the fur brush and the toner is the combined force of mechanical and electrostatic forces. With this in view, the brush is made of Teflon which is apt to be charged to a polarity opposite to the polarity of the toner. The toner removed from the drum surface sticks to the tips of the brush 38 and, as the fur brush is rotated, it is knocked down by the flicker 40. This part of the toner is carried by the air stream toward the scavenger roller 42 and the counterelectrode 44 of the toner collector 30. It will be noted that Teflon used for the fur brush 38 is superior to other materials concerning the separation from a mold and is desirable for the toner to be knocked down.

As previously described, the dc power source 50 (see FIG. 5) applies to the scavenger roller 42 a voltage opposite in polarity to the charge on the toner, i.e. negative (−) voltage in this particular embodiment (e.g. (−) 5 kilovolts voltage), and to the counterelectrode 44 a positive (+) voltage common in polarity to the toner. Therefore, the toner entrained by the air stream is attracted by the scavenger roller 42 to deposite on its surface. As the scavenger roller 42 rotates in the direction indicated by the arrow, the toner and impurities on the scavenger roller 42 reach the separator 42. The separator 46 scrapes off a coarse part of the impurities. The blade 47 next to the separator 46 scrapes off the toner into a toner discharging device 49. In the meantime, that part of the toner which is floating in the air without being attracted by the scavenger roller 42 due to the rapid air stream and impurities entrained by the air stream are sucked by the air filter 48 to be wasted.

The toner collector 30 in accordance with the present invention includes unique means for effectively eliminating the previously discussed drawbacks inherent in the prior art tonner collector. The drawbacks are that a part of toner removed by the fur brush 38 and toner deposited on impurities which are entrained by the air stream stick to the counterelectrode 44 and accumulate thereon with the lapse of time, and that in the case where very fine toner particles are used, part of the toner particles removed by the fur brush 38 is attracted by the scavenger roller 42 to adhere fixedly thereto with the lapse of time. Hereinafter will be described some embodiments of the present invention.

Figure 2:
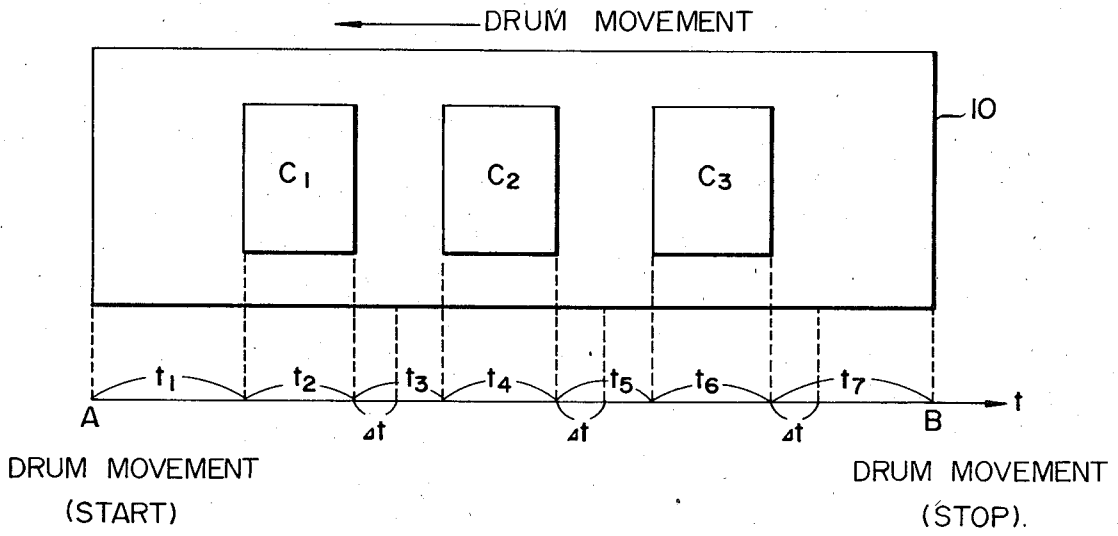
FIG. 2 is a diagram illustrative of the principle of operation of a first embodiment of the collecting device in accordance with the present invention.

Referring to FIG. 2, the varying position of the drum 10 is shown with respect to time (t) which is viewed from a location where the cleaning unit 32 is installed. In FIG. 2, A designates a time at which the rotation of the drum 10 begins in response to a copy start, while B designates a time when the rotation of the drum 10 ends in response to a copy end. Assume, for example, that an image on the document 16 is to be focused to three spaced imaging areas $C_1$, $C_2$ and $C_3$ on the drum surface to thereby produce three copies continuously. That is, the imaging areas $C_1$, $C_2$ and $C_3$ are the portions in which toner images will be formed and residual toner will deposite.

With the lapse of time (t), the imaging areas $C_1$, $C_2$ and $C_3$ sequentially move past the cleaning unit 32 each with residual toner deposited thereon so that the residual toner is removed by the fur brush 38. More specifically, the fur brush 38 cleans the areas $C_1$, $C_2$ and $C_3$ respectively for the periods $t_2$, $t_4$ and $t_6$ shown in FIG. 2, but not in the other periods $t_1$, $t_3$, $t_5$ and $t_7$. In each of the periods $t_2$, $t_4$ and $t_6$ during which cleaning occurs, the residual toner removed by the fur brush 38 is successively fed into the toner collector of the present invention and, therefore, the scavenger roller 42 and the counterelectrode 44 are respectively applied with the voltages of the predetermined polarities from the dc power source 50 (see FIG. 5) at least throughout such periods. In practice, however, the scavenger roller 42 does not end the deposition of the residual toner as soon as the cleaning operation of the fur brush 38 ends, but ends it with some delay. In light of this, the application of the voltages to the scavenger roller 42 and the counterelectrode 44 occurs over each of the periods plus a delay time $\Delta t$ as shown in FIG. 2, i.e. $t_2+\Delta t$, $t_4+\Delta t$ and $t_6+\Delta t$.

An experiment was conducted in which the polarities of the voltages applied to the scavenger roller 42 and the counterelectrode 44 were repeatedly switched each to the opposite polarity for each period $t_7$ between the end of cleaning performed on the imaging area $C_3$ and the end of rotation of the drum 10, time B. During such repeated operations, there were measured the amount of toner progressively accumulating on the counterelectrode 44, the amount of impurities carrying toner therewith, and the amount of very fine toner particles progressively sticking fast to the scavenger roller 42. In the experiment, the operation of the copier was stopped after the production of five copies and this 5-copy operation cycle was repeated to produce about 60,000 copies in total. The voltages applied to the scavenger roller 42 and the counterelectrode 44 were (±) 5 kilovolts. The result of the experiment is shown in FIG. 3 together with a result related to the case where the polarities were not changed over.

Figure 3:
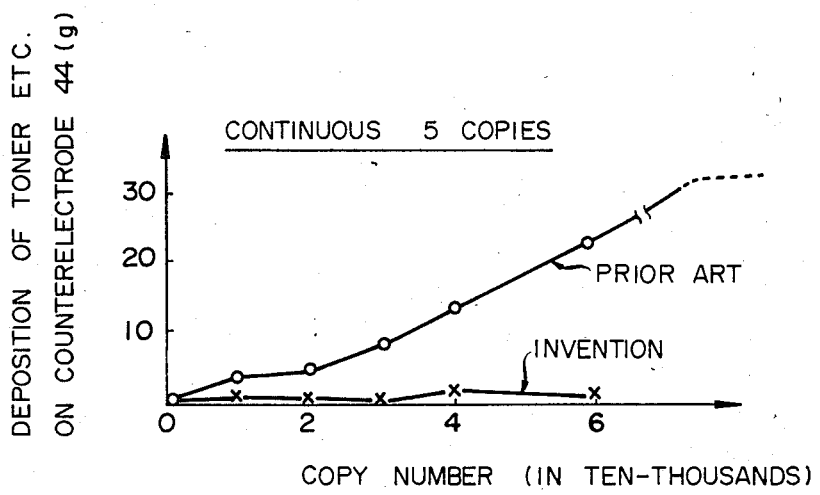
FIGS. 3 and 4 show graphs indicative of the results of experiments which were conducted employing the first embodiment.

In FIG. 3, the curve with circles (O) represents the prior art wherein the polarities are not switched, while the curve with crosses (X) represents the present invention wherein the polarities are switched in the manner described. As shown, where the polarities of the impressed voltages were not switched at all, toner and the like gradually deposited on the counterelectrode 44 with the increase in the number of copies until it reached saturation at a certain amount after 60,000 copies were produced. In contrast, where the polarities were switched for the specific period $t_7$ as in the experiment, the amount of toner and the like deposited on the counterelectrode remained substantially zero despite the increase in copy number. It was also found that switching the polarities cuts down the amount of toner sticking fast to the scavenger roller 42 to about 1/8 to 1/11 compared to the non-switched case.

Figure 4:
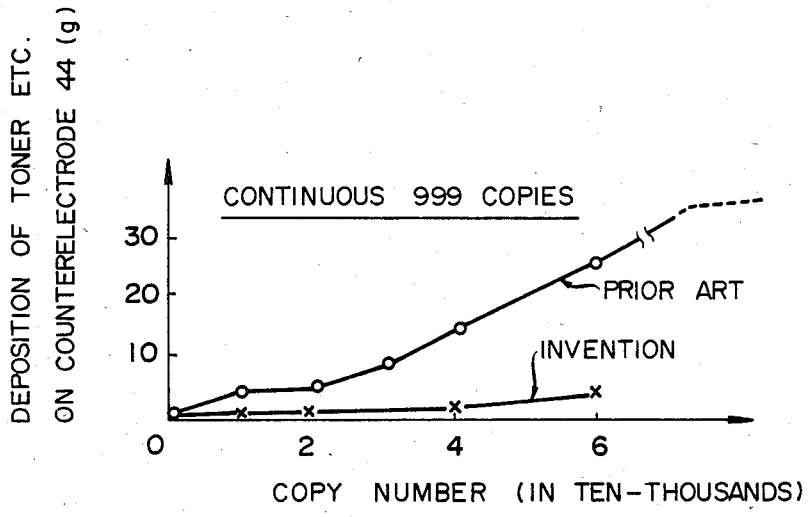

Another experiment was conducted in which the operation of the copier was stopped after producing 999 copies continuously and this 999-copy cycle was repeated to produce 60,000 copies in total, as in the first experiment. However, the result was not favorable, that is, the decrease in the amount of deposition of toner and the like was not more than 20–30% compared to the non-switched case. Such was assumed to result from an occurrence that since the time period required for producing 999 copies is about 17 minutes, the high voltage applied for this long period of time allows toner and the like to deposite on the counterelectrode 44 to eventually stick fast thereto. With this assumption, another experiment was conducted in which the polarities were switched not only for the period $t_7$ but also for the other periods which are the period $t_3$ between the imaging areas $C_1$ and $C_2$ and the period $t_5$ between the imaging areas $C_2$ and $C_3$, and the result was favorable. This is represented by curves shown in FIG. 4. It will be seen from FIG. 4 that the resultant amount of deposition of toner and the like is smaller by 80–85% than in the non-switched case.

The present invention has been elaborated in consideration of the above-described results of experiments, that is, in view of the fact that the deposition of toner and the like on the counterelectrode 44 and scavenger roller 42, which constitute the toner collector, can be remarkably reduced by inverting the polarities of the voltages applied to the counterelectrode 44 and scavenger roller 42 only for a predetermined period which is the period $t_7$ shown in FIG. 2, or each of the periods $t_7$, $t_3$ and $t_5$.

A practical construction of the toner collector in accordance with the present invention will be described with reference to FIGS. 5–7.

In the toner collector 30 of the present invention shown in FIGS. 5 and 6, the counterelectrode 44 and the scavenger roller 42 are supplied with bias voltages of (+) 5 kilovolts and (−) 5 kilovolts from the dc power source 50 alternately at the timing described hereinabove. A voltage polarity changeover device, or switch as will be referred to, 52 is associated with the dc power source 50 in order to so switch the polarities of the voltages. The switch 52 in turn is controlled by a controller 54 which senses each of the periods $t_1$–$t_7$ in the duration A-B to generate a polarity change signal Pc associated with the sensed period. The switch 52 for driving the dc power source 50 may comprise a mechanical switch such as shown in FIG. 7, a reed relay, an electronic switch consisting of a semiconductor switching device, etc. For the controller 54, use may be made of a sensor responsive to some imaging areas on the drum surface and a microcomputer for storing the imaging areas.

Figure 8:
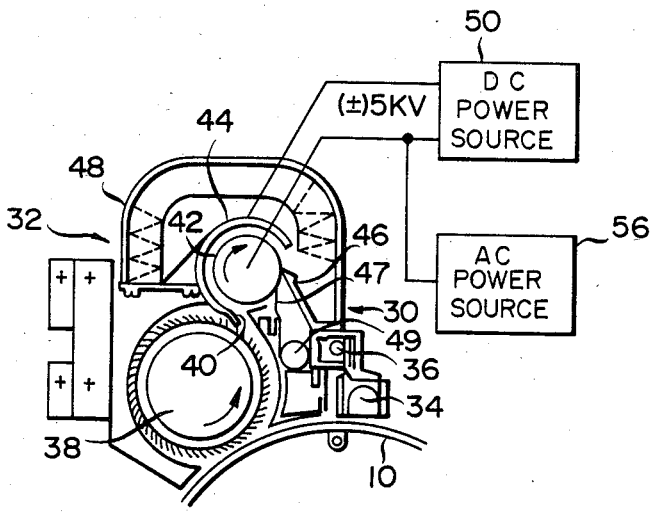
FIG. 8 is a view of a second embodiment of the present invention and the whole cleaning unit in which it is built.
Figure 9:
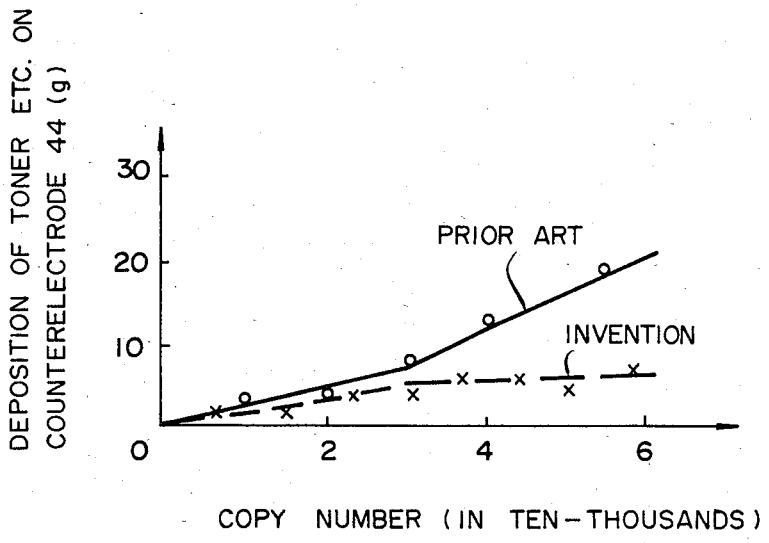
FIG. 9 shows a graph indicative of a result of an experiment which was conducted employing the second embodiment.
Figure 10:
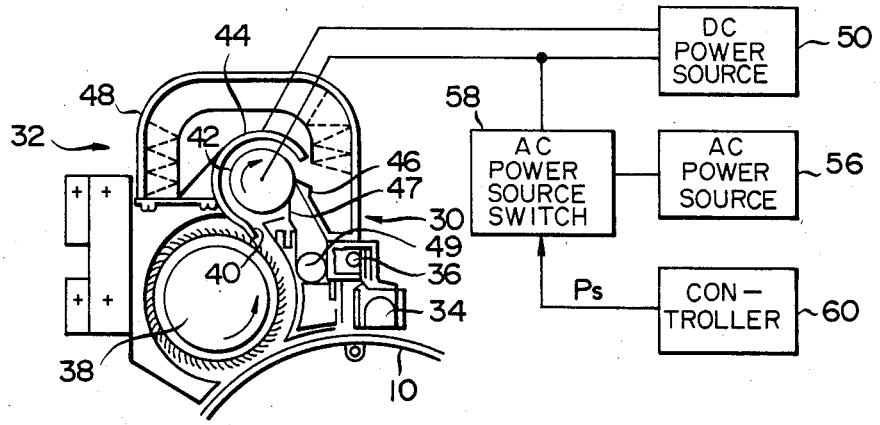
FIG. 10 is a view of a modification to the second embodiment.

Referring to FIGS. 8–10, a second embodiment of the present invention is shown in detail. In contrast to the first embodiment werein the polarities of dc bias voltages applied to the scavenger roller 42 and counterelectrode 44 are switched each at a predetermined timing by the switch 52, the second embodiment, as shown in FIG. 8, applies a dc bias voltage to the counterelectrode 44 by the dc power source 50 but, to the scavenger roller 42, applies a composite voltage consisting of the dc voltage from the dc power source 50 and an ac voltage from an ac power source 56. Specifically, utilizing the periodic variation of an ac voltage, the second embodiment causes the force exerged by the scavenger roller 42 for attracting toner and impurities to vary and, further, gives the scavenger roller 42 a repulsive force against toner and impurities, thereby preventing them from accumulating and sticking fast on the scavenger roller 42 with the lapse of time.

For example, when a negative (−) 5 kilovolts dc voltage was applied from the dc power source 50 to the counterelectrode 44 and a 2.5 kilovolts (peak-to-peak value), 400 herts ac voltage was applied superposed on the dc voltage from the ac power source 56 to the scavenger roller 42, the result shown in FIG. 9 was obtained. In FIG. 9, the curve marked with circles (O) represents a prior art in which only a dc voltage (−5 kilovolts) is applied to the scavenger roller 42, showing that the deposition of toner and the like on the counterelectrode 44 increases substantially in proportion to the number of copies when 60,000 copies are produced. On the other hand, the curve marked with crosses (X) represents the present invention in which an ac voltage is superposed on a dc voltage; it will be seen that the deposition of toner and the like on the counterelectrode 44 is not more than 30% compared to the prior art, after the production of 60,000 copies. It will also be seen that the deposition in accordance with this particular embodiment reaches saturation when about 30,000 copies are produced. The ac voltage was varied within the range of 1–10 kilovolts (peak-to-peak value) and 50–900 herts to attain results which were commonly superior to that of the prior art.

While in the second embodiment an ac voltage is constantly applied to the scavenger roller 42 superposed on a dc voltage as described above, it may be applied only when cleaning is not performed as in the first embodiment, i.e. periods $t_1$, $t_3$, $t_5$ and $t_7$ shown in FIG. 2. This will compensate for the deterioration of the function of capturing toner and the like assigned to the scavenger roller 42. In such a case, as shown in FIG. 10, an ac power source switching device 58 is connected between the ac power source 56 and the scavenger roller 42, and a controller 60 is installed which senses each of the periods $t_1$, $t_3$, $t_5$ and $5_7$ shown in FIG. 2 and applies an output signal Ps associated with the sensed period to the switching device 58 to superpose the ac voltage. Needless to mention, the devices 58 and 60 may be constructed using a mechanical or electronic switch, a sensor responsive to the imaging areas on the surface of the drum 10, a microcomputer, etc., as in the first embodiment.

Figure 5:
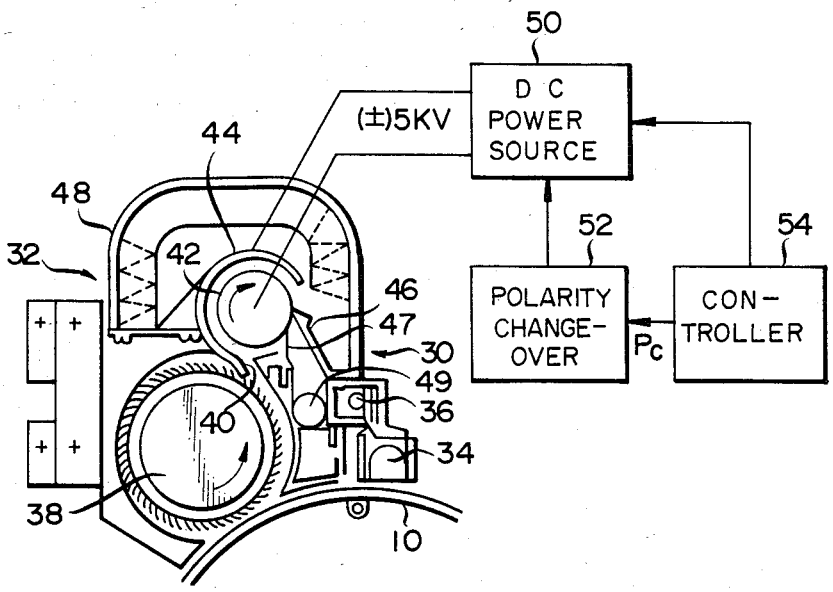
FIG. 5 is a view of the first embodiment of the present invention and the whole cleaning unit in which it is built.
Figure 6:
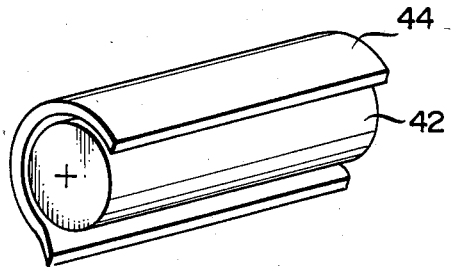
FIG. 6 is a perspective view of a scavenger roller and a flat counterelectrode installed in the collecting device of FIG. 5.
Figure 7:
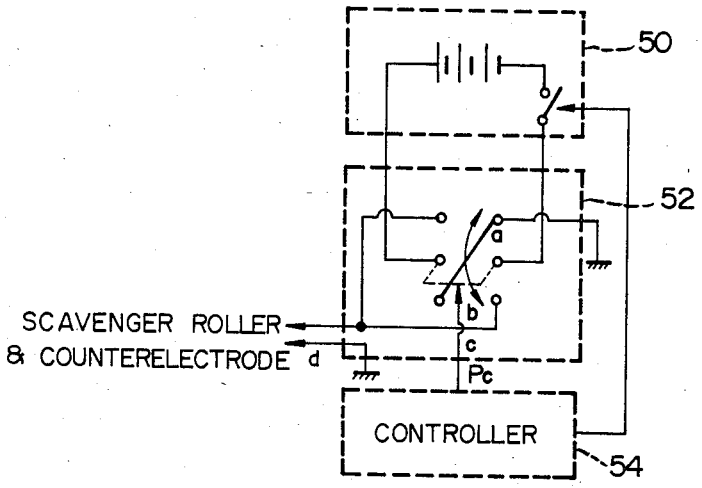
FIG. 7 is a diagram of a specific example of a voltage polarity changeover device included in the arrangement of FIG. 5.
Figure 11:
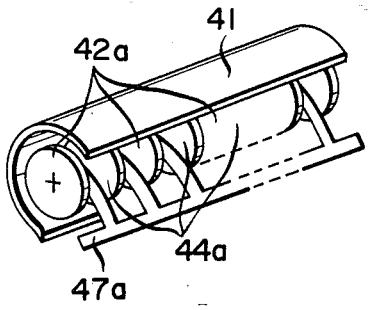
FIG. 11 is a view of a modification to the scavenger roller and the counterelectrode which constitute the residual toner collector of the present invention.

In any of the foregoing embodiments, the combination of the scavenger roller 43 and the counterelectrode 44 shown in FIGS. 5 and 6 are only illustrative and various modifications may be made. One possible modification may comprise, as shown in FIG. 11, a plurality of sets of disc-shaped rotatable electrodes 42*a* and 42*b* which face each other, and a guide and side plate 41 adapted to guide toner from the fur brush 38 while covering the electrodes 42*a* and 42*b*. In the structure shown in FIG. 11, the rotatable electrodes 41*a* are equivalent in function to the scavenger roller 42, and the other rotatable electrodes 44*a* to the counterelectrode 44. Since voltages of different polarities are applied to the electrode plates 41*a* and the electrode plates 44*a*, toner deposite on their surfaces and then scraped off by a blade 47*a* to be collected.

Further, in the embodiments shown and described, the toner collector is built in a cleaning unit of the fur brush type. Alternatively, it may be used with any other type of cleaning unit such as a magnet brush type cleaning unit.

In summary, it will be seen that a residual toner collecting device for an electrophotographic copier of the present invention effectively removes toner and various impurities which tend to adhere to a scavenger roller and a counterelectrode in a cleaning unit of the copier and almost 100% removal is achieved in a particular copy mode, as was proved by experiments. This outstanding advantage is derived from the unique construction wherein dc voltages applied to the scavenger roller and the counterelectrode are switched each to the opposite polarity at a predetermined timing, i.e. for a period between the end of cleaning of toner remaining in an image area on the surface of a photoconductive element and the start of the next copying operation and even for those periods between nearby image areas during which cleaning is needless, and an ac voltage is applied to the scavenger roller superposed on a dc voltage either constantly or only for those periods during which cleaning is needless.

Various modifications will become possible for those skilled in the art after receiving the teachings of the present disclosure without departing from the scope thereof.

What is claimed is:

1. A device for collecting an untransferred dry process developer for use with a cleaning device which removes untransferred dry process developer particles having a charge of a first polarity remaining on an image bearing member of an image forming apparatus, said device comprising:

(a) a dc bias power source;

(b) a first electrode member connected to said dc bias power source and being thereby charged with a dc bias voltage opposited in polarity to said charge of said first polarity;

(c) a second electrode member connected to said dc bias power source and being thereby charged with a dc bias voltage of the same polarity as said charge of said first polarity; and (d) bias voltage control means connected to said dc bias power source and said first and second electrode members for varying the magnitude of each of said dc bias voltages of said first and second electrode members.

2. A device as claimed in claim 1, in which the bias voltage control means comprises bias voltage polarity changeover means for changing polarities of the dc bias voltages each to an opposite polarity.

3. A device as claimed in claim 2, in which the bias voltage control means further comprises control means for controlling the bias voltage polarity changeover means to change polarities of the dc bias voltage each to an opposite polarity only for a predetermined period at a predetermined interval.

4. A device as claimed in claim 3, in which said predetermined period is a period between an end of cleaning operation of the cleaning unit and an end of movement of the image bearing member.

5. A device as claimed in claim 3, in which said predetermined period is, of a period between a start of movement of the image bearing member and an end of movement of the image bearing member, all the period except for a period during which cleaning the image bearing member is required.

6. A device as claimed in claim 1, in which the bias voltage control means comprises an ac power source for superposing an ac bias voltage to at least one of the dc bias voltages which are applied to the first and second electrode members.

7. A device as claimed in claim 6, in which the bias voltage control means comprises ac power source switching means connected between the electrode member applied with said one dc bias voltage and the ac power source, and control means for superposing the ac bias voltage from the ac power source to said one dc bias voltage for a predetermined period of time at a predetermined interval.

8. A device as claimed in claim 7, in which said predetermined period is a period between an end of cleaning operation of the cleaning unit and an end of movement of the image bearing member.

9. A device as claimed in claim 7, in which said predetermined period is, of a period between a start of movement of the image bearing member and a stop of movement of the image bearing member, all the period except for a period during which cleaning the image bearing member is required.

10. A device as claimed in claim 1, in which the image forming apparatus comprises an electrophotographic copier, the image bearing member comprising a photoconductive element, the dry process developer comprising toner.

11. A device as claimed in claim 1, in which the first electrode member comprises a scavenger roller and the second electrode member comprises a counterelectrode member.

12. A device for collecting untransferred residual toner for use with a cleaning unit which removes untransferred toner particles having a charge of a first polarity remaining on a photoconductive element of an electrophotographic copier, comprising:

(a) a dc bias power source;

(b) a first electrode member connected to said dc bias power source and being thereby charged with a dc bias voltage opposite in polarity to said charge of said first polarity;

(c) a second electrode member connected to said dc bias power source and being thereby charged with a dc bias voltage of the same polarity as said charge of said first polarity; and (d) bias voltage polarity changeover means connected to said dc bias power source and said first and second electrode members for changing polarities of the dc bias voltages of each of the first and second electrode members to the opposite polarity for a predetermined period at a predetermined interval.

13. A device for collecting untransferred residual toner for use with a cleaning unit which removes untransferred toner particles having a charge of a first polarity remaining on a photoconductive element of an electrophotographic copier, comprising:

(a) a dc bias power source;

(b) a first electrode member connected to said dc bias power source and being thereby charged with a dc bias voltage opposite in polarity to said charge of said first polarity;

(c) a second electrode member connected to said dc bias power source and being thereby charged with a dc bias voltage of the same polarity as said charge of said first polarity; and (d) ac bias voltage superposing means for superposing an ac bias voltage for a predetermined period at a predetermined interval to at least one of said dc bias voltages of the first and second electrode members.

* * * * *